US006612453B2

(12) United States Patent
Joo-Tai

(10) Patent No.: US 6,612,453 B2
(45) Date of Patent: Sep. 2, 2003

(54) MULTIPURPOSE STORAGE BASKET

(75) Inventor: Choi Joo-Tai, Seongnam (KR)

(73) Assignee: Sedo Camping Co., Ltd. (KR)

( * ) Notice: Subject to any disclaimer, the term of this patent is extended or adjusted under 35 U.S.C. 154(b) by 0 days.

(21) Appl. No.: 09/798,856

(22) Filed: Mar. 1, 2001

(65) Prior Publication Data

US 2002/0030052 A1 Mar. 14, 2002

(30) Foreign Application Priority Data

Sep. 8, 2000 (KR) ..... 2000-25649

(51) Int. Cl.[7] ..... A45C 13/04; A45C 13/26
(52) U.S. Cl. ..... 220/9.2; 383/9
(58) Field of Search ..... 220/9.2, 505; 383/9

(56) References Cited

U.S. PATENT DOCUMENTS 1,454,388 A * 5/1923 Lauren ..... 220/9.2
1,730,898 A * 10/1929 Percival ..... 383/38
2,828,858 A * 4/1958 Tooke ..... 206/221
3,014,516 A * 11/1961 Mueller ..... 220/9.2
3,026,539 A * 3/1962 Lewis ..... 220/9.2
3,480,059 A * 11/1969 Schoening ..... 220/9.2
3,838,758 A * 10/1974 Brown ..... 383/38
4,094,351 A * 6/1978 Catenaccio ..... 224/609
5,503,476 A * 4/1996 Hamdan ..... 383/9
5,800,067 A * 9/1998 Easter ..... 220/9.2
5,964,533 A * 10/1999 Ziglar ..... 220/9.2

* cited by examiner

*Primary Examiner*—Joseph M. Moy
(74) *Attorney, Agent, or Firm*—Pendorf & Cutliff

(57) ABSTRACT

Disclosed is a multipurpose storage basket which is capable of unfolding without any separate tool and while not in use, folding in an easy manner, thereby making it easy to be kept and carried in more convenient manner. The storage basket comprises: a skeleton body (11) formed by surrounding a coil spring with a covering cloth; and a cloth (12) sewed on the skeleton body (11) in the unfolded shape of the skeleton body (11), whereby the storage basket takes a substantially cylindrical shape and capable of unfolding or folding by the elasticity of the coil spring without using any separate instrument and folding in an easy manner, thereby making it easy to be kept and carried in more convenient manner. Thus, the storage basket is provided with a cover 20 made of the same gauze material. Accordingly, the storage basket could be folded and fixed in an easy manner while not in use, thereby being kept even in a small area of space. Also, the storage basket is easy to establish on inside or outside the tent, which enables to keep the various articles hygienically and effectively during outdoors living or the camping.

1 Claim, 3 Drawing Sheets

MULTIPURPOSE STORAGE BASKET

BACKGROUND OF THE INVENTION

1. Field of the Invention

The present invention relates to a multipurpose storage basket for storing all kinds of articles at home or out of doors in an efficient manner and more particularly, to a multipurpose storage basket which is capable of unfolding without any separate instrument and while not in use, folding in an easy manner, thereby making it easy to be kept and carried in more convenient manner.

2. Description of the Related Art

A storage basket, which is used to store laundry, toys, dolls and the like at home, is of various materials and shapes. However, a general storage basket takes a fixed shape and it has a large dimension, such that while not in use, it unnecessarily occupies a large area of space and also is not easy to be kept and carried.

Additionally, even if the storage basket is of an assembled body, there occurs a problem that it is inconvenient to assemble or disassemble it.

SUMMARY OF THE INVENTION

Accordingly, an object of the invention is to provide a multipurpose storage basket which is capable of unfolding without any separate instrument and while not in use, folding in an easy manner, thereby making it easy to be kept and carried in more convenient manner.

To accomplish this and other objects of the present invention, there is provided a multipurpose storage basket comprising: a skeleton body formed by surrounding a coil spring with a covering cloth; and a cloth sewed on the skeleton body in the unfolded shape of the skeleton body, whereby the storage basket takes a substantially cylindrical shape and unfolds or folds by the elasticity of the coil spring.

BRIEF DESCRIPTION OF THE DRAWINGS

The invention will further be described more in detail below, by way of example, with reference to the accompanying drawings, in which.

DETAILED DESCRIPTION OF THE PREFERRED EMBODIMENTS

Figure 1:
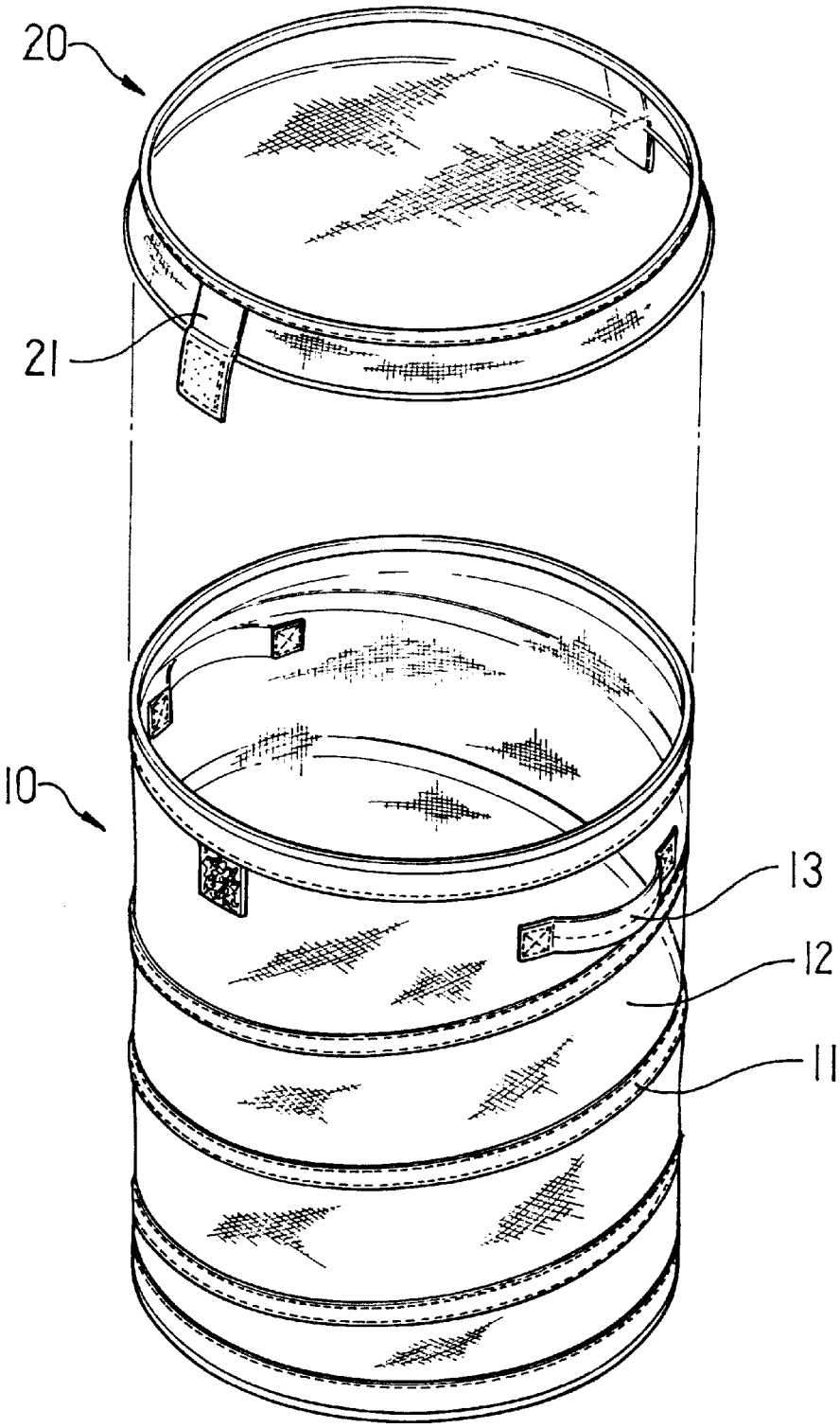
FIG. 1 is an exploded perspective view illustrating the unfolded state of the multipurpose storage basket according to the present invention.

FIG. 1 is an exploded perspective view illustrating the unfolded state of the multipurpose storage basket according to the present invention. In construction, the storage basket 10 comprises: a skeleton body 11 as the body of the storage basket 10 with a coil spring wound in a spiral shape; and a cloth 12 sewed on the skeleton body 11 in the unfolded shape of the skeleton body 11, whereby the storage basket takes a substantially cylindrical shape.

Of course, the cloth 12 is provided on the bottom surface of the storage basket 10 and in the preferred embodiment of the present invention, preferably made of gauze having an excellent airing. Therefore, it is adequate to store the laundry or foods requiring airing for the safe storage and as the interior of the storage basket 10 is seen, it is advantageous that the contents therein may be checked.

The skeleton body 11 is made by surrounding the coil spring of a spring steel with a covering cloth, which prevents the coil spring of the metal material from being exposed upon the contact to moisture or water, thereby avoiding the direct damage of the coil spring and enhancing a quality of an outer appearance thereof.

In the preferred embodiment of the present invention, the coil spring is made of a zinc steel wire and the covering cloth is used with a synthetic fiber.

The end of the coil spring is rigidly fixed on the body of the coil spring, with a consequence that the secured end portion thereof is surrounded with the covering cloth in a neat manner.

In this way, the fixation of the end of the coil spring may be carried out by means of an adhesive tape or a separate means.

Further, the storage basket is provided with a cover 20 made of the same gauze material as in the basket body and a handle 13 made of a cloth sewn at an appropriate position, for carrying the storage basket.

Further, the storage basket 10 may have a multi-layer structure where the articles stored in the interior thereof can be divided by kinds. In other words, the storage basket 10 is provided with a compartment cloth 14 functioning as the compartment therein.

Figure 2:
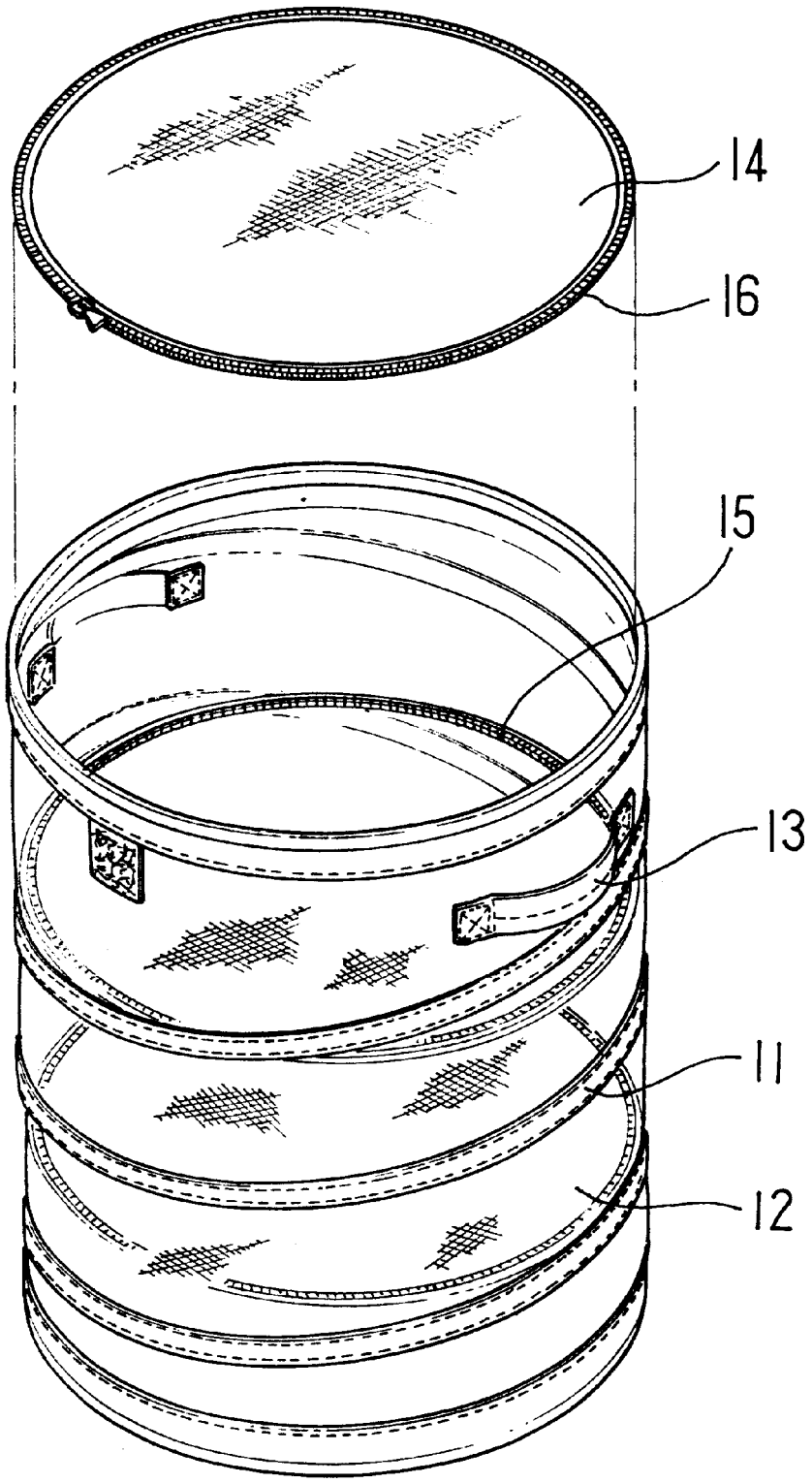
FIG. 2 is a perspective view illustrating the multipurpose storage basket having a multi-layer separated structure according to the present invention.

As shown in FIG. 2, the compartment cloth 14 is mounted by means of for example a set of zippers.

In more detail, a first zipper 15 is mounted on the inner peripheral surface of the cloth 12 constituting the body of the storage basket 10 on the one side thereof and a second zipper 16 engaging with the first zipper 15 is mounted on the outer peripheral surface thereof, thereby completing the mounting of the compartment cloth 14. If necessary, the storage basket 10 may be compartmented in multiple layers.

The compartment cloth 14 is preferably made of the same gauze material as in the cloth 12 constituting the body of the storage basket 10, and in addition to the zippers, the compartment cloth 14 may be installed by virtue of any other means.

Figure 3:
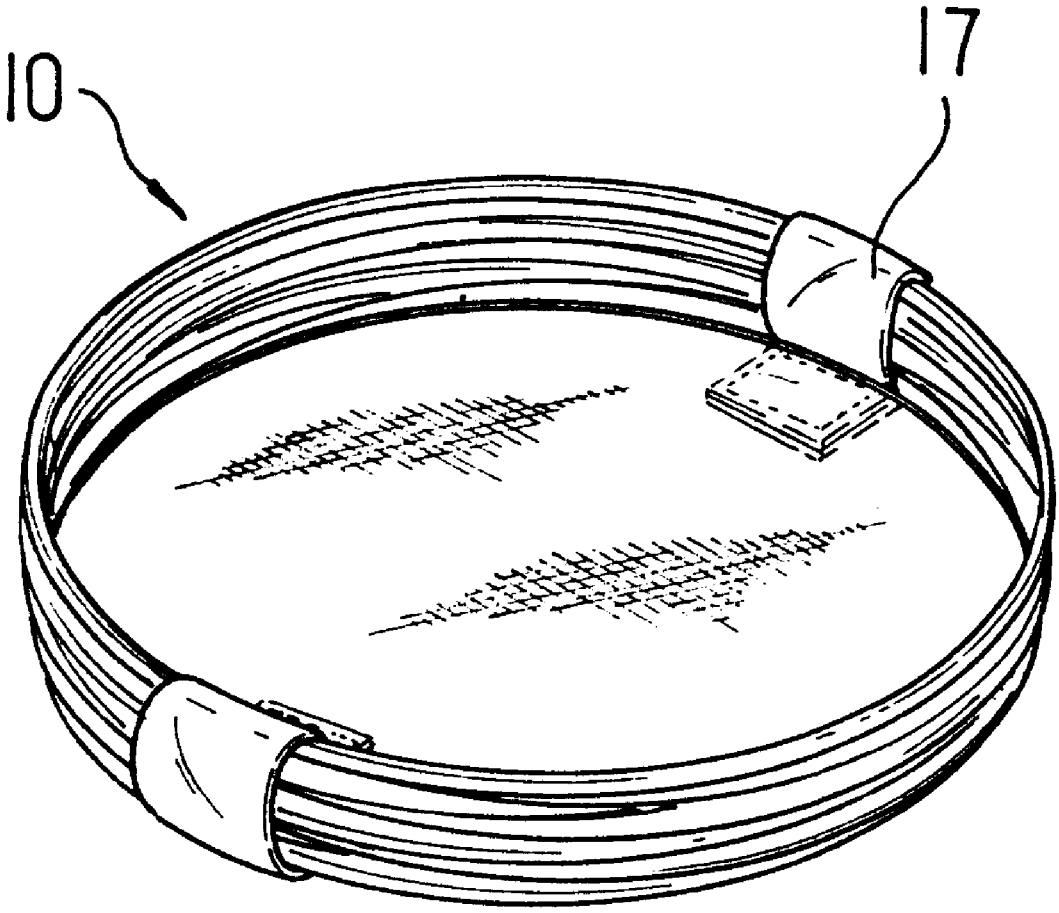
FIG. 3 is a perspective view illustrating the folded state of the multipurpose storage basket according to the present invention.

FIG. 3 is a perspective view illustrating the folded state of the multipurpose storage basket according to the present invention. If the storage basket 10 of the present invention is pressed downward, the coil spring is compressed and thus folded in an easy manner. In this way, on the bottom surface of the storage basket 10 there is provided a fixing band 17 on which a Velcro tape is attached, for surrounding the folded storage basket 10 to thereby fix it on the Velcro tape attached on the outside of the bottom surface of the storage basket 10.

Also, the cover 20 is provided with a band 21 on which the Velcro tape is attached for fixing the cover 20 on the storage basket 10.

In other words, if the Velcro tape of the band 21 on the cover 20 is attached on the Velcro tape of the top portion of the storage basket 10, the cover 20 can be opened and closed in an easy manner.

Therefore, if the storage basket of the present invention is to be used, the Velcro tape of the fixing band 17 is detached, such that the storage basket is unfolded by the elasticity of the coil spring itself of the skeleton body 11.

On the other hand, while not in use, the coil spring is pressed downward and folded, such that the storage basket is fixed by means of the fixing band 17, thereby being kept even in a small area of space.

In addition, the storage basket 10 of the present invention has the body made of gauze material having a good airing, such that it is good for health and easily checks the contents therein.

As set forth in the above, there is provided a multipurpose storage basket capable of folding to be fixed in an easy manner, during not in use, thereby increasing the efficiency of space utilization and being carried to be installed in a tent or the interior or exterior of a sunshade tent out of doors, thereby storing various kinds of articles in sanitary and efficient manners.

Additionally, a multipurpose storage basket of the present invention is capable of storing various kinds of articles, thereby being used for multipurpose and dividing the stored articles by kinds, thereby improving the convenience of use and ensuring a high product compatibility.

What is claimed is:

1. A multipurpose storage basket comprising:

a skeleton body (11) having a inner peripheral surface, wherein the skeleton body is formed by surrounding a coil spring with a covering cloth;

a cloth (12) sewed on the skeleton body (11), wherein the cloth includes an outer peripheral surface;

at least one compartment cloth adapted to divide the storage basket in multiple compartments, and a first zipper mounted in the inner peripheral surface of the skeleton body and a second zipper mounted on the outer peripheral surface of the compartment cloth;

wherein the first zipper is adapted to engage with the second zipper to form the multiple compartments, and wherein the storage basket takes a substantially cylindrical shape and unfolds or folds by the elasticity of the coil spring.

* * * * *